US005701640A

United States Patent [19]

Locher

[11] Patent Number: 5,701,640

[45] Date of Patent: Dec. 30, 1997

[54] APPARATUS FOR CLOSING WRIST STRAPS

[76] Inventor: Hans Locher, Kurvenstrasse 14, CH-8610 Uster, Switzerland

[21] Appl. No.: 545,700

[22] PCT Filed: Mar. 2, 1995

[86] PCT No.: PCT/CH95/00048

§ 371 Date: Nov. 6, 1995

§ 102(e) Date: Nov. 6, 1995

[87] PCT Pub. No.: WO95/24139

PCT Pub. Date: Sep. 14, 1995

[51] Int. Cl.[6] ..... A44B 11/25

[52] U.S. Cl. ..... 24/303; 335/285; 24/265 WS

[58] Field of Search ..... 24/303, 66.1, 71 J, 24/70 J, 265 WS; 335/285; 292/251.5

[56] References Cited

U.S. PATENT DOCUMENTS

| | | | |
|---|---|---|---|
| 2,637,887 | 5/1953 | Goodman et al. | 24/303 |
| 2,654,929 | 10/1953 | Feibelman | 24/201 |
| 4,021,891 | 5/1977 | Morita | 24/303 |
| 4,456,384 | 6/1984 | Murakami | 368/10 |
| 4,458,395 | 7/1984 | Aoki | 24/303 |
| 4,527,311 | 7/1985 | Aoki | 24/303 |
| 4,571,199 | 2/1986 | Murakami | 446/73 |
| 4,593,440 | 6/1986 | Tsamas | 24/265 WS |
| 4,622,726 | 11/1986 | Nakamura | 24/590 |
| 4,779,314 | 10/1988 | Aoki | 24/303 |
| 5,191,685 | 3/1993 | Aoki et al. | 24/265 WS X |
| 5,249,338 | 10/1993 | Aoki | 24/303 |
| 5,274,889 | 1/1994 | Morita | 335/285 X |
| 5,317,789 | 6/1994 | Levy | 24/303 |

FOREIGN PATENT DOCUMENTS

| | | |
|---|---|---|
| 2 413 847 | 10/1974 | Germany . |
| 2 855 708 | 7/1979 | Germany . |
| 3 606 879 | 9/1986 | Germany . |
| 3 643 350 | 7/1987 | Germany . |
| 3 736 254 | 5/1989 | Germany . |
| 57-007104 | 1/1982 | Japan . |
| 2 186 625 | 8/1987 | United Kingdom . |

*Primary Examiner*—Peter M. Cuomo
*Assistant Examiner*—Stephen Vu
*Attorney, Agent, or Firm*—Burns, Doane, Swecker & Mathis, LLP

[57] ABSTRACT

A strap closure for straps of wrist watches comprises a magnetic closure and an automatic mechanical lock. The closure comprises two closure parts (1, 2) and at least one permanent magnet (16) and a yoke (9), which form parts of a magnetic circuit. Said magnetic circuit is disposed inside a shield (6) made of a ferromagnetic material and closed as far as possible on all sides. Between the magnetic circuit (9, 15, 16) and said shield or other closure parts there is no metallic contact whatsoever with elements of high permeability, the magnetic circuit is instead isolated from the shield or from other closure parts by air gaps (22, 23) and fastening elements (14) of a low permeability close to the value of air.

19 Claims, 3 Drawing Sheets

FIG. 1b
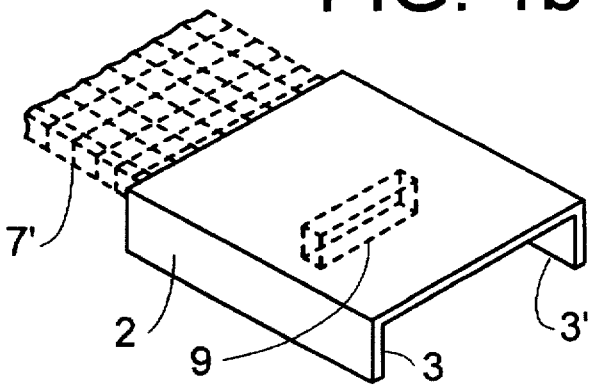
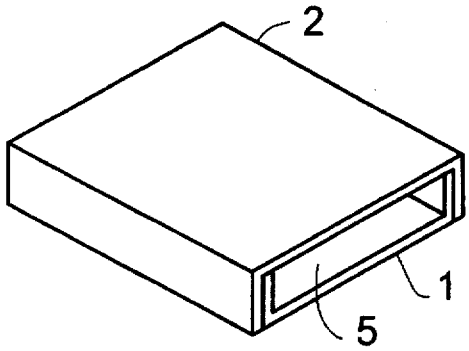
FIG. 1a
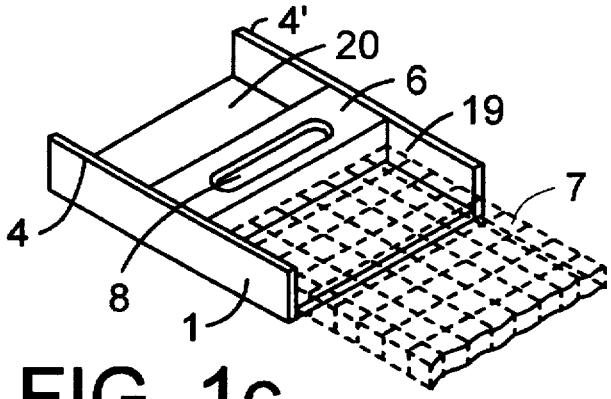
FIG. 1c
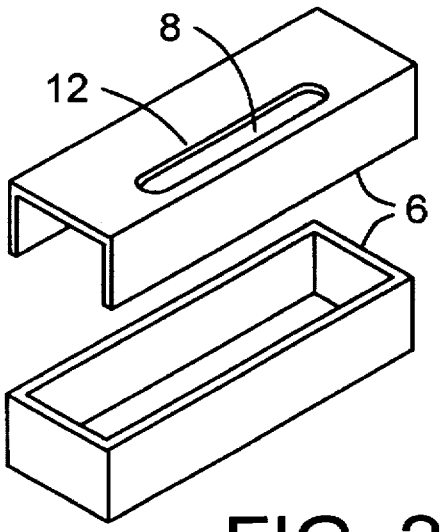
FIG. 2
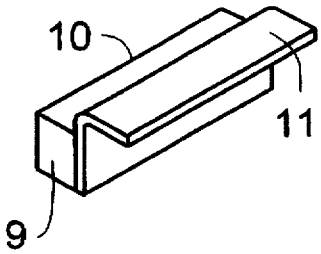
FIG. 3

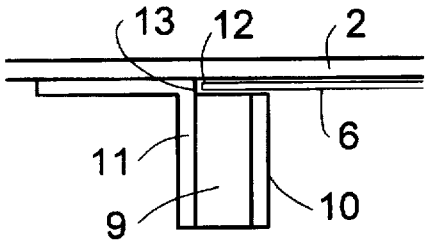
FIG. 4a
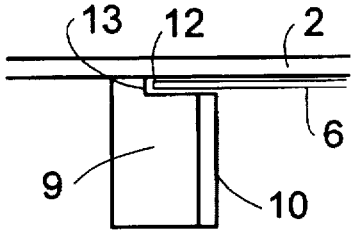
FIG. 4b
FIG. 5
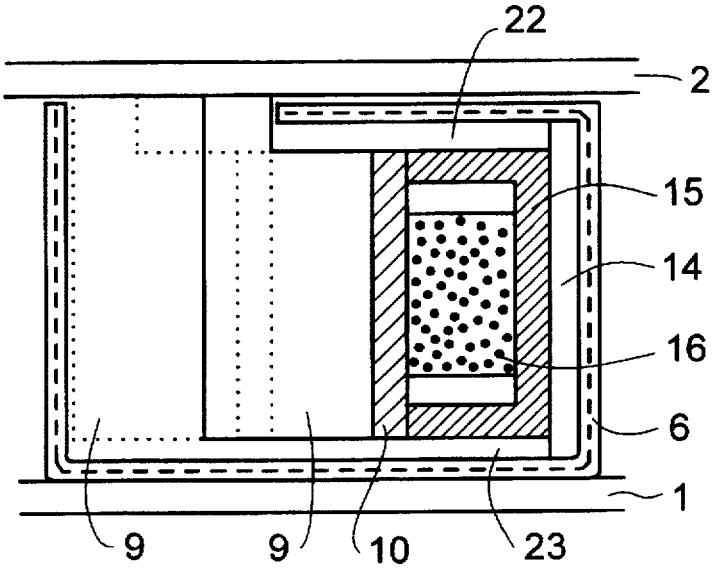
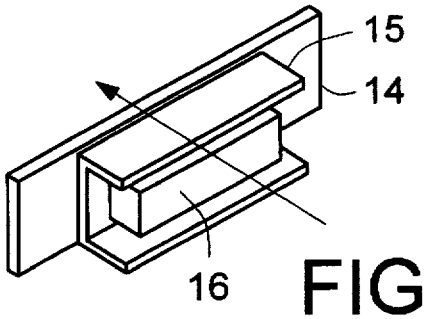
FIG. 6
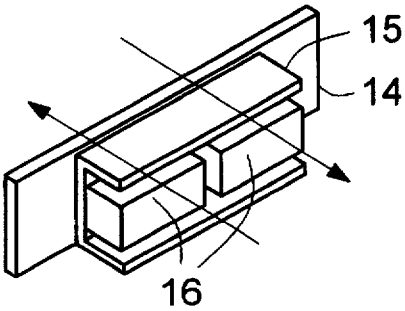
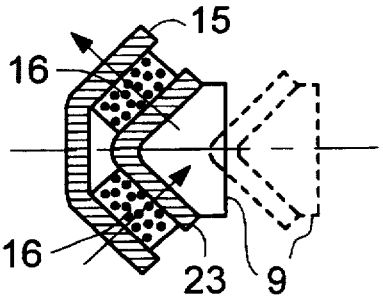
FIG. 7

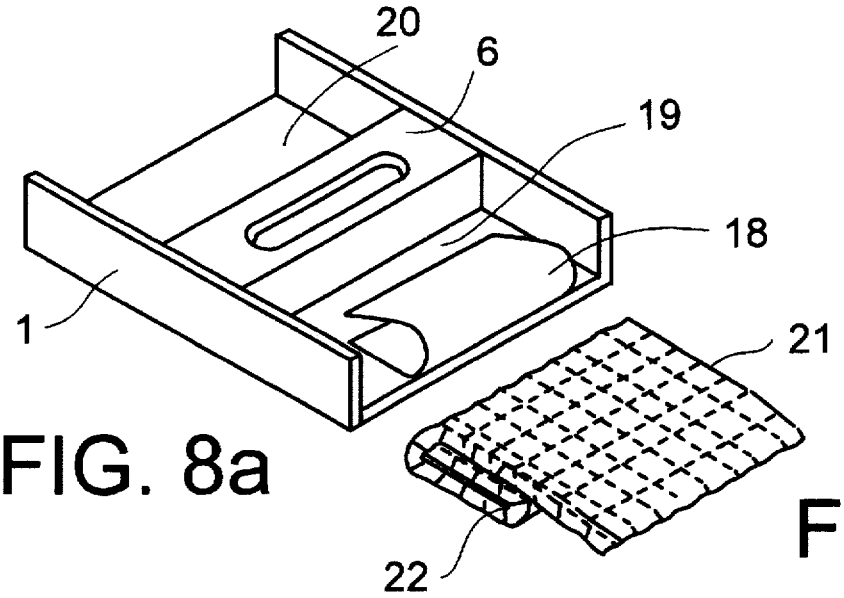
FIG. 8a
FIG. 8b
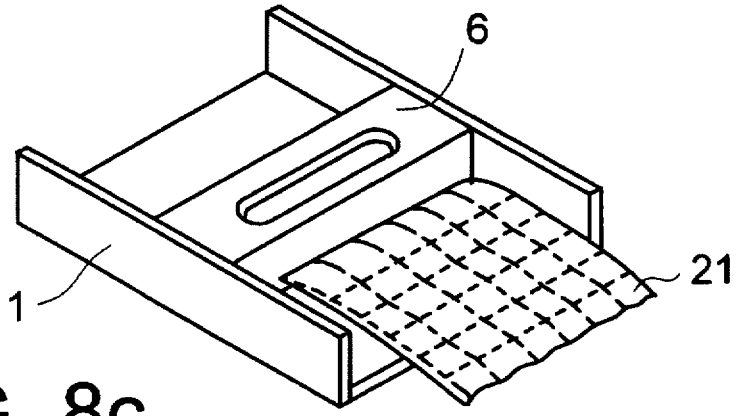
FIG. 8c
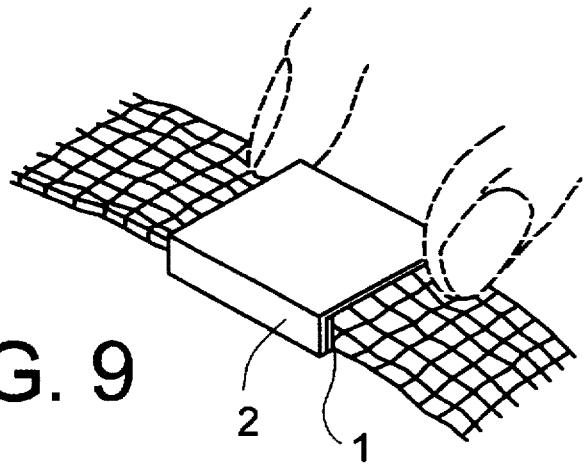
FIG. 9

APPARATUS FOR CLOSING WRIST STRAPS

FIELD OF THE INVENTION

The present invention lies in the field of closures for wrist straps, in particular for straps of wrist watches. The most commonly used closures are currently buckle closures. They guarantee secure closure of the two strap ends, are easy to adapt to the wrist size of the watch wearer and are also inexpensive to manufacture.

BACKGROUND OF THE INVENTION

The buckle closure is however somewhat awkward to position around the wrist, both during fastening and during unfastening. It requires a relatively stiff watch strap on account of the holes, which have to absorb the tensile forces effective in the strap. The material used is almost exclusively leather or plastic. Woven textile straps would, in terms of pattern and color, admittedly be more suitable as watch straps but they may not be satisfactorily combined with the buckle closure.

Mechanical closures are also being used instead of buckles, although mainly for metal watch straps. With such closures, however, adaptation to the size of the wrist is critical and the mechanical closure parts, e.g. the springs, impose fairly high quality requirements during manufacture.

Numerous solutions for closures are known which utilize the force of attraction of permanent magnets. The German patent specification DE 2 855 708 C2 held by Kodama discloses a magnetic closure, in which a permanent magnet in a magnetic circuit attracts a second closure piece. Here, a separating force of around 4N (newtons) is attained, with there being no provision for an additional mechanical lock, e.g. by the positive engagement of one part behind another. This solution however calls for relatively strong magnetic fields and there is therefore still no reliable guarantee that the closure will not be torn off or accidentally opened.

Other solutions likewise involve the attraction of the two closure parts connected to the strap ends by means of permanent magnets, although in the end position a mechanical lock is additionally provided so that the tensile force acting upon the two closure parts is absorbed, not by the magnetic adherence force, but by a mechanical catch.

In U.S. Pat. No. 4,622,726, Nakamura discloses a solution in which, in the attracted state of the two closure parts, one part, as a result of being rotated slightly about its own axis relative to the other part, is moved into a mechanical notch which is capable of withstanding even high tensile forces. The drawback of said solution is that locking does not occur automatically but requires an additional specific manual movement.

Up until now, however, such closures having permanent magnets have not been able to gain acceptance in the field of watch straps, for various reasons.

One important reason is certainly the fact that the accuracy of all timepieces is impaired to a greater or lesser extent by strong magnetic fields. Timepieces may admittedly be protected by special ("anti-magnetic") measures against magnetic fields but this entails considerable extra cost.

The quartz watches with an analogue display which are currently dominating the watch market are based on a stepper motor, which contains a rotating magnet and is therefore very sensitive to magnetic interference fields. If, when the wrist watch is taken off, the closure part fitted with a permanent magnet comes near to the clockwork mechanism, its accuracy is impaired to an unacceptable extent.

The currently available magnetic closures obviously do not satisfy the requirements regarding the leakage field intensity when the closure is open so that their use, at least with quartz watches, is still largely precluded.

SUMMARY OF THE INVENTION

The invention relates to a device for a magnetic closure for wrist straps, in particular for wrist watches, having two closure parts and having permanent magnets which connect the two closure parts by means of a magnetic latching force.

The object of the present invention is to indicate a magnetic closure for wrist watches which, even in the open state, in the event of accidental contact with the clockwork mechanism does not impair its accuracy and indeed achieves this also in quartz watches which do not have so-called "anti-magnetic" protection. Furthermore, the wristwatch closure according to the invention, after joining of the two closure parts, is to lock automatically in such a mechanical manner that opening may be effected only by a deliberate specific manual movement.

The manner in which said object is achieved according to the invention is characterized in that the magnetic circuit comprising permanent magnets, pole shoes and yoke is magnetically isolated from the other closure parts, specifically by means of air gaps or connection parts of very low permeability. In addition, an at least substantially closed shield encloses the magnetic circuit, with the exception of an opening through which the yoke of the magnetic circuit, which is fastened to one of the closure parts, extends.

The area of the opening in the all-round shield is kept low enough for the leakage magnetic field emerging at said point to remain below the field intensity which is acceptable even for the very sensitive clockwork mechanisms.

The magnetic closure is very easy to handle. During closure, the top closure part is placed approximately centrally onto the lower closure part, whereupon the yoke part slides into the shield opening provided in the lower closure part, thereby effecting automatic locking. Release of the closure is effected by using two fingers to exert moderate pressure upon the lateral surfaces of the two closure parts at the strap ends, which have to be displaced by about 2 mm relative to one another so that the top closure part is released and may be lifted off in an upward direction.

The magnetic circuit housed in the shield may be made very small and only takes up about 8 mm (viewed in strap direction). There is thus still enough room in the closure parts to accommodate the two strap ends. At both ends, small reserves of strap may be provided and even in such a way that the strap length may be lengthened or shortened by a total of 15 to 20 mm in increments of around 5 mm.

BRIEF DESCRIPTION OF THE DRAWINGS

There follows a description of the invention with reference to embodiments and drawings, which show:

FIGS. 1*a*–1*c* are the structural designs of an embodiment of the closure device according to the invention in a perspective view, FIG. 2 is a constructional variant of the magnetic shield which encloses the magnetic circuit, in a perspective view, FIG. 3 is a detail variant of the yoke of the magnetic circuit, in a perspective view, FIGS. 4*a*–4*b* are two detail variants of arrangements for achieving a mechanical locking of the yoke in the attracted state, in the form of a diagrammatic sectional view, FIG. 5 is a sectional view through the middle of the magnetic closure, FIG. 6 are detail variants for the arrangement of the permanent magnets, in perspective view, FIG. 7 is a further detail variant for the arrangement of two permanent magnets, in the form of a horizontal sectional view through the middle of the closure, FIGS. 8*a*–8*c* fixing of the strap ends to the closure parts and shortening/lengthening of the strap, FIG. 9 the movement required to open the locked magnetic closure.

DESCRIPTION OF PREFERRED EMBODIMENT

FIGS. 1*a*–1*c* show the two closure parts 1 and 2, closure part 1 resting against the inside of the wrist while closure part 2 comes to lie above the closure part 1. Both closure parts 1 and 2 comprise a shell-shaped section, preferably a flat channel section, with closure part 2 having a greater inside width than closure part 1 to enable it to be placed over the closure part 1. Both closure parts are provided with lateral flanges 3, 3' and 4, 4' respectively so as to produce a cavity 5 between them, in the manner shown in FIG. 1.

Disposed in said cavity 5 is the magnetic circuit which is enclosed by the magnetic shield 6, which is visible in the drawing FIG. 1*c*. On either side of the shield 6 there are two niches 19 and 20 which are used to fix the two strap ends 7 and 7' in position. The straps to be fixed in position are indicated by a grid-like structure in the drawings.

The yoke 9 which moves relative to the magnetic circuit and its shield 6, is fastened to the top closure part 2 in such a way that, once the closure has been joined, the yoke projects through the window-like opening 8 in the magnetic shield 6 into the cavity 5.

FIG. 2 shows a constructional variant of the magnetic shield 6. The shield 6 according to the invention is to be such that it is at least substantially closed. The effect thereby achieved is that, when the magnetic circuit is open, i.e., in the absence of the yoke 9, only a very small fraction of the magnetic field passes outside of the shield 6 and may act as an interference field for the, in the extreme case, adjacent clockwork mechanism. A window-like opening 8 is used to allow passage of the movable yoke 9, which is fastened to the top closure part 2. When selecting the dimensions of the yoke 9, therefore, another objective is to keep the area of the opening 8 as small as possible.

A preferred variant for the manufacture of an all-round shield 6 consists of the two-part construction according to FIG. 2, namely a 5-sided trough, which may be manufactured using a deep-drawing die, and a cover with lateral flanges which may be placed over the trough. As a material, the so-called "soft iron" may be used. Sheet iron, as generally used for electrical transformers, is suitable. This material has the two important characteristics of good conductivity for the magnet flux and no permanent magnetism. A very thin sheet metal about 0.3 mm thick is in fact sufficient to provide an excellent shielding effect.

The window-like opening 8 in the shield 6 additionally performs the task of locking the two closure parts 1 and 2 in the attracted state, achieved by means of the edge 12 cooperating with a corresponding notch 13 in the yoke 9, in the manner illustrated in FIGS. 4*a* and 4*b*.

FIG. 3 is a perspective, greatly enlarged view of the design of the yoke 9. The lateral surface 10 faces towards, and is attracted by the magnetic field. As indicated in FIG. 1*b*, fastening to the underside of the closure part 2 may be effected, for example, by means of an angle iron 11.

FIG. 4 is a diagrammatic sectional view of the automatic mechanical lock according to the invention in the closed state. Said lock is to prevent unintentional or even violent removal of the top closure part 2 in the closed state.

In the construction according to FIG. 4*a*, the yoke 9 is fastened by an angle element 11 to the top closure part 2 in such a way as to produce a notch 13, which is roughly 0.5–1 mm wide. Upon attraction of the yoke by the magnetic field, the top closure part 2 is moved by about 2 mm, the notch 13 of the yoke 9 sliding over the edge 12 of the shield into the lock. Said state is maintained until the magnetic closure is intentionally released by a specific movement so that the lock is also released.

FIG. 4*b* shows a construction without the angle shaped element 11 for fastening the yoke 9 to the closure part 2. Here, the notch is formed by a cutting into the yoke 9 at the point of connection to the closure part 2. With said solution, the supporting surface of the yoke has to be made wide enough to achieve stable fastening.

FIG. 5 is a greatly enlarged longitudinal section through the magnetic closure. For reasons of clarity, the following markings have been incorporated into the drawing:

permanent magnet: stippled ferromagnetic parts: hatched magnetic shield: dashed line.

The yoke 9 fastened to the top closure part 2 is shown in two instantaneous states: firstly, immediately after joining the two closure parts 1 and 2 but still before horizontal displacement under the influence of the magnetic field (dotted lines), and then subsequent to magnetic attraction (solid lines).

The yoke 9 is made of a material of very low permeability but carries a ferromagnetic layer 17 on its side facing the magnetic field. The magnetic field is thereby prevented from passing via the yoke 9 through the opening 8 in the shield 6 to the outside.

The magnetic circuit comprises at least one permanent magnet 16 and a pole shoe 15. The pole shoe 15 is fastened to the inside of the shield 6 by an intermediate layer 14 of very low permeability, which serves as a supporting surface. The air gaps 22 and 23 prevent any metal contact between the lateral surfaces of the pole shoe 15 and the shield 6. The construction according to the invention is such that the magnetic circuit may be regarded as "floating" relative to the shield 6. There is specifically no metal contact of high permeability between the magnetic circuit and the shield 6, nor with any closure parts outside of the shield 6.

A marginal magnetic field of low intensity is formed only at the window-like opening 8 of the shield 6. Said component may additionally be minimized by skillful construction and dimensioning of the closure.

FIG. 6 shows perspective views of two possible variants for the arrangement of the permanent magnets 16, namely one having a single permanent magnet 16 and one having two permanent magnets 16 disposed alongside one another. Magnetization is in any case at right angles to the front of the permanent magnets 16 and is marked by arrows. When two permanent magnets 16 are used, it is advantageous to select a bidirectional polarity in the manner indicated likewise by arrows. In the case of a relatively wide closure, it may even be advantageous to use three permanent magnets 16 disposed at intervals alongside one another, which may then have correspondingly smaller dimensions.

FIG. 7 shows a variant of the arrangement of the permanent magnets 16, specifically in the form of a sectional view through the middle of the permanent magnets. In said arrangement, two permanent magnets 16 disposed approximately at right angles to one another are used, the magnetization and polarity being marked by arrows. The permanent magnets 16 are provided on a common pole shoe 15. The yoke 9 is shown in two positions, namely in the position immediately after the two closure parts 1 and 2 have been superimposed (dashed lines) and in the position after the yoke 9 has been attracted by the magnetic field. The yoke 9 is made of a material of low permeability but is provided, at its surface in contact with the pole shoe 15 or the permanent magnets 16, with a ferromagnetic layer 23 of high permeability. In said manner, the magnetic field is prevented from passing via the yoke 9 through the opening 8 in the shield 6 to the outside.

Said arrangement gives rise to a force-locking positioning of the yoke 9 onto the center line, which is advantageous. It also offers certain advantages in terms of spatial requirement.

FIGS. 8*a*–8*c* illustrate the way in which the two ends 7 and 7' of the watch strap may be fixed in position. The niches 19 and 20 intended for fixing the strap ends 7 and 7' in position arise on either side of the shield 6 in the closure part 1. With wrist watches, however, it is absolutely essential for the wearer of the watch to be able himself to shorten or lengthen the strap length by about 10–15 mm. The strap closure according to the invention permits him to do so in the following manner.

A thin leaf spring 18 made of steel or plastic and bent into a U shape is fastened transversely in the niche 19 in such a way as to produce a pocket large enough to accommodate a small reserve of strap. FIG. 8*b* shows a watch strap 21 made of a textile material. Such a strap may easily be glued to a rigid plastic strip 22, around which the strap may be wound. The depth of the niches 19 and 20 is sufficient for 3–4 layers of strap wound one on top of the other. In the present example according to FIG. 8*b*, there are two further layers in addition to the glued layer.

In most cases it should be desirable to use both niches 19 and 20 in an identical manner, in which case the closure part 2 is provided with a leaf spring 18' and used in precisely the same manner. Thus, both a lengthening and a shortening of 10–15 mm in increments of about 5 mm is readily possible.

The prepared strap according to FIG. 8*b* is inserted into the niche 19 and fixed in said position by means of the spring 18. Even high tensile forces in the strap 21 are unable to pull the strap according to FIG. 8*c* out of the niches 19 and 20 because there is self-locking of the strap rolls 21 and 21' with the leaf springs 18 and 18'.

FIG. 9 illustrates opening of the magnetic closure. The lock simultaneously actuated by the magnetic closure is such that during all activities, including sporting activities, the closure cannot open by itself. Opening is effected exclusively by a movement of the kind illustrated in FIG. 9. Said movement comprises gripping both sides of the closure parts 1 and 2 between, for example, the thumb and index finger of the right hand, the thumb exerting pressure on the top closure part 2 while the index finger exerts the counterpressure on the bottom closure part 1. As a result, the magnetic adherence force is overcome and the two closure parts are displaced by about 2 mm relative to one another. It requires only a slight downward pressure by the thumb towards the wrist for the closure part 2 to spring upwards and be removable.

What is claimed is:

1. A strap closure apparatus for wrist straps, in particular straps of wrist watches, said apparatus having a magnetic closure and an automatic mechanical lock for two closure parts and comprising at least one permanent magnet for providing magnetic force and a yoke forming part of a magnetic circuit, and a shield (6) comprising ferromagnetic material of comparatively high permeability substantially enclosing said magnetic circuit and being magnetically isolated from said magnetic circuit by air gaps (22, 23) and elements (14) whose permeability is lower than the permeability of the shield.

2. A strap closure apparatus according to claim 1, wherein said yoke (9) is made of a material of low permeability and at its side facing said at least one permanent magnet (16) carries a layer (17) of ferromagnetic material.

3. A strap closure apparatus according to claim 1, wherein said shield (6) is made of a non-metallic material and is covered on all sides with a layer of ferromagnetic material.

4. A strap closure apparatus according to claim 3, wherein said shield (6) has a slot (8) therein for the passage of a carrier (11) for the yoke part of the magnetic circuit.

5. A strap closure apparatus according to claim 4, wherein an edge (12) of said slot (8) is used for the mechanical locking of the two closure parts (1) and (2).

6. A strap closure apparatus according to claim 1, comprising two permanent magnets (16) having end faces disposed at an angle of between approximately 60° and 120° relative to one another on a common pole shoe (15), and a yoke (9) having a shape corresponding to the end faces of the permanent magnets (16).

7. A strap closure for straps of wrist watches, comprising a first closure part adapted to be fixed to an end of one strap and a second closure part adapted to be fixed to an end of another strap for cooperation with said first closure part to connect together said ends of said straps; said first closure part including a permanent magnet and shielding material of high magnetic permeability surrounding said permanent magnet except for a narrow slot in said shielding material and being spaced from and magnetically unconnected to said permanent magnet; and said second closure part including an element of magnetic material shaped for movement into said slot to complete a magnetic circuit induced by said permanent magnet.

8. A strap closure according to claim 7, wherein said shielding material is a box surrounding said permanent magnet and comprising ferromagnetic material.

9. A strap closure according to claim 8, wherein said element of magnetic material is part of a yoke assembly, and wherein said yoke assembly and said box are moveable into a mechanically coupled relationship to one another after insertion of said element of magnetic material into said slot.

10. A strap closure according to claim 9; wherein said yoke assembly has a notch therein, and wherein said mechanically coupled relationship is attained by extending the strap to which said second closure part is fixed to position said element of magnetic material over said narrow slot, inserting said yoke assembly into said slot far enough to align said notch with an edge of said slot, and shifting said second closure part to cause said notch to embrace said edge to inhibit withdrawal of said yoke assembly from said slot.

11. A strap closure comprising a first closure part adapted to be fixed to an end of one strap and a second closure part adapted to be fixed to an end of another strap for overlying and cooperating with said first closure part to connect together said ends of said straps; said first closure part including permanent magnet means, a shield in the form of a box substantially surrounding said permanent magnet means and comprising ferromagnetic material of high permeability, said box having first and second end portions and a top wall with a slot therein at said first end portion, and means for mounting said permanent magnet means inside said second end portion of said box and magnetically isolating said shield from said permanent magnet means, and said second closure part including an element comprising magnetic material adapted for movement through said slot into a position inside said box and spaced from said shield to complete within said shield a magnetic circuit induced by said permanent magnet means.

12. A strap closure according to claim 11, wherein said permanent magnet means is polarized in a direction extending lengthwise of the interior of said box.

13. A strap closure according to claim 12, wherein said permanent magnet means comprises first and second permanent magnets and mounting means positioning said magnets within said second end portion of said box.

14. A strap closure according to claim 13, wherein said permanent magnets are oppositely polarized.

15. A strap closure according to claim 12, wherein said element is part of a yoke assembly having a notch therein and wherein said yoke assembly and said box are moveable into a mechanically coupled relationship attained by positioning said element over said slot in said top wall of said box, inserting said yoke assembly into said slot far enough to align said notch with an edge of said slot, and shifting said second closure part to cause said notch to embrace said edge to inhibit withdrawal of said yoke assembly from said slot.

16. A strap closure according to claim 15, wherein said notch has an extent in the lengthwise direction of said box to permit said element comprising magnetic material to contact said permanent magnet means within said box.

17. A strap closure according to claim 11, wherein said element comprising magnet material is part of a yoke assembly, and wherein said yoke assembly and said box are moveable into a mechanically coupled relationship to one another after insertion of said element into said slot.

18. A strap closure according to claim 17, wherein said yoke assembly has a notch therein, and wherein said mechanically coupled relationship is attained by extending the strap to which said second closure part is fixed to position said element comprising magnetic material over said slot, inserting said yoke assembly into said slot far enough to align said notch with an edge of said slot, and shifting said second closure part to cause said notch to embrace said edge to inhibit withdrawal of said yoke assembly from said slot.

19. A strap closure according to claim 18, wherein said notch has an extent in the lengthwise direction of said box to permit said element comprising magnetic material to contact said permanent magnet means within said box.

* * * * *